US010283309B2

(12) United States Patent
Craig

(10) Patent No.: US 10,283,309 B2
(45) Date of Patent: May 7, 2019

(54) FUSE PANEL MODULE WITH A MOVABLE FUSE HOLDER

(71) Applicant: TE CONNECTIVITY CORPORATION, Berwyn, PA (US)

(72) Inventor: Evan Lawrence Craig, Vernon Hills, IL (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/609,661

(22) Filed: May 31, 2017

(65) Prior Publication Data

US 2018/0350547 A1 Dec. 6, 2018

(51) Int. Cl.

| | |
|---|---|
| ***H01H 85/22*** | (2006.01) |
| ***H01R 13/629*** | (2006.01) |
| ***H01H 85/54*** | (2006.01) |
| ***H01H 85/47*** | (2006.01) |

(52) U.S. Cl.

CPC ..... *H01H 85/22* (2013.01); *H01H 85/47* (2013.01); *H01H 85/547* (2013.01); *H01R 13/62905* (2013.01); *H01H 85/54* (2013.01)

(58) Field of Classification Search

CPC ..... H01H 85/22; H01H 85/25; H01H 85/54–85/60; H01H 85/47; H01R 13/62905

USPC ..... 337/208, 215

See application file for complete search history.

(56) References Cited

U.S. PATENT DOCUMENTS 3,419,839 A * 12/1968 Matthews ..... H01H 85/202 337/186
4,178,061 A 12/1979 Ahroni
4,268,106 A * 5/1981 Moerre ..... H01H 85/545 337/194
4,488,767 A * 12/1984 Lehman ..... H01H 85/547 337/213
4,543,557 A * 9/1985 Schaefer ..... H01H 85/547 337/196
4,768,978 A * 9/1988 Wettengel ..... H01H 85/24 337/210

(Continued)

FOREIGN PATENT DOCUMENTS

| | | |
|---|---|---|
| EP | 2426687 A2 | 3/2012 |
| GB | 2082851 A | 3/1982 |
| GB | 2098008 A | 11/1982 |

OTHER PUBLICATIONS

European Search Report, dated Oct. 18, 2018, EP 18 17 4193, International Application No. 18174193.5-1204.

*Primary Examiner* — Anatoly Vortman
*Assistant Examiner* — Jacob Crum

(57) ABSTRACT

A panel fuse module for use with one or more fuses. The panel fuse module includes a housing with a first fuse contact and a second fuse contact. The first fuse contact is resiliently deformable and is mounted on a post of the housing. A movable fuse holder is provided which is moveable relative to the housing and relative to the first fuse contact. A cam member is provided on the movable fuse holder. As the movable fuse holder is moved from the first position toward the second position, the cam member cooperates with the first fuse contact to move the first fuse contact from a less-stressed first position to a more-stressed second position to allow the respective fuse of the one or more fuses to be inserted into the housing without engaging the first fuse contact.

19 Claims, 4 Drawing Sheets

(56) References Cited

U.S. PATENT DOCUMENTS

| | | | | |
|---|---|---|---|---|
| 5,816,858 | A * | 10/1998 | Kazarian | H01H 85/2045 439/366 |
| 5,969,587 | A * | 10/1999 | Combas | H01H 85/545 335/132 |
| 6,727,797 | B1 * | 4/2004 | Bruchmann | H01H 9/104 337/194 |
| 6,734,580 | B1 * | 5/2004 | Bruchmann | H01H 85/32 307/112 |
| 2008/0184560 | A1 * | 8/2008 | Pizzi | H01H 69/02 29/883 |
| 2014/0009255 | A1 * | 1/2014 | Lu | H01H 85/545 337/180 |

* cited by examiner

FUSE PANEL MODULE WITH A MOVABLE FUSE HOLDER

FIELD OF THE INVENTION

The present invention relates to a fuse panel module to allow access to one or more fuses. More particularly, the invention is directed to a fuse panel module having a movable fuse holder.

BACKGROUND OF THE INVENTION

Fuses are a common component found in many electrical devices. In general, fuses are electrical safety components consisting of a wire or strip that melts and interrupts a circuit when the current passing through the fuse exceeds a particular amperage. Once a fuse is blown, i.e., the wire or strip melts, the fuse must be replaced to re-establish the circuit.

Replacing blown fuses in fused electrical devices often requires disassembly of the electrical device and/or use of one or more hand-tools to access and retrieve a blown fuse. Accordingly, accessing and replacing a blown fuse can often be a difficult, cumbersome and time-consuming process.

In addition, although current panel fuse holders connect the fuses while insolating them from the user, they compromise either panel space, contact stability or fuse current capability. A fuse holder must tolerate high fuse temperature, conduct heat away from the fuse and fit in a housing. Metal contacts survive high temperatures while conducting heat away from the fuse. Axial fuse holders, which minimize panel space by presenting the smallest profile of the fuses to the user, must make contact with the proximal end of the fuse after the housing accepts the distal end. This is presently done either by a movable proximal fuse contact, actuated by a part of the dielectric cover, or a fuse contact mounted on the cover that connects through an additional, separable contact to the housing circuit. Such axial fuse holders cannot tolerate much heat. In the first case, the dielectric cover that actuates the fuse contact cannot tolerate high fuse temperatures, and its movable fuse contact cannot conduct much heat. In the second case, the separable contact generates heat and restricts heat transmission from the fuse. Radial fuse holders present both ends of a fuse to fixed metal fuse contacts but occupy more panel space.

It would, therefore, be beneficial to provide a fuse panel module in which the fuses could be inserted and removed without damage to the fuse or the fuse contacts. In addition, it would be beneficial to provide a fuse panel module which combines the compact advantage of axial fuse holders with the thermal advantages of radial fuse holders.

SUMMARY OF THE INVENTION

An object is to provide a fixed proximal fuse contact that is mounted in a housing of a fuse panel module and which is opened by a camming member while a distal end of the fuse passes through the proximal contact. As the proximal end of the fuse enters the proximal fuse contact, the camming member releases the proximal fuse contact onto the proximal fuse head. Meanwhile, a distal fuse contact mounted in the housing receives the distal fuse head. Both fuse contacts are permanently connected to the housing circuit, are metal and provide preload to maintain a stable fuse contact. This creates less heat and provides superior transmission of heat away from the fuses, with the minimal panel footprint of an axial fuse holder.

An embodiment is directed to a panel fuse module for use with one or more fuses. The panel fuse module includes a housing with a first fuse contact and a second fuse contact. The first fuse contact is resiliently deformable and is mounted on a post of the housing. The second fuse contact is mounted on the post of the housing and spaced from the first fuse contact. A movable fuse holder is provided which is moveable relative to the housing and relative to the first fuse contact. The movable holder is movable from a first position in which a portion of the movable fuse holder extends from the housing and one or more fuses may be inserted into the movable fuse holder without engaging the first fuse contact or the second fuse contact to a second position in which the movable fuse holder is inserted into the housing. A cam member is provided on the movable fuse holder. As the movable fuse holder is moved from the first position toward the second position, the cam member cooperates with the first fuse contact to move the first fuse contact from a less-stressed first position to a more-stressed second position to allow the respective fuse of the one or more fuses to be inserted into the housing without engaging the first fuse contact. As the movable fuse holder is moved into the second position, the cam member disengages the first fuse contact to allow the first fuse contact to move toward the less-stressed first position to allow the first fuse contact to be provided in mechanical and electrical engagement with the respective fuse of the one or more fuses.

An embodiment is directed to a panel fuse module for use with one or more fuses. The panel fuse module includes a housing having a fixed post, a fixed rail and a fuse holder. The fuse holder is movable relative to the fixed post, and the fixed rail from a first position in which a respective fuse of the one or more fuses is positioned in the fuse holder to a second position in which the respective fuse and the fuse holder are inserted into the housing. A first fuse contact is mounted on the fixed post proximate the front of the housing. A second fuse is mounted on the fixed post spaced from the first fuse contact toward the rear of the housing. A cam member is provided on the movable fuse holder. As the fuse holder is moved from the first position toward the second position, the cam member cooperates with the first fuse contact to move the first fuse contact from a less-stressed first position to a more-stressed second position to allow the respective fuse to be inserted into the housing without engaging the first fuse contact. As the fuse holder is moved into the second position, the cam member disengages the first fuse contact to allow the first fuse contact to move toward the less-stressed first position to allow the first fuse contact to be provided in mechanical and electrical engagement with the respective fuse of the one or more fuses.

An embodiment is directed to a method of terminating a fuse in a fuse panel module, the fuse module having a first fuse contact and a second fuse contact. The method includes: inserting the fuse into a movable fuse holder of the fuse panel module; moving the movable fuse holder from a first position in which the fuse does not engage the first or second fuse contact to a second position in which the fuse is provided in mechanical and electrical engagement with the first and second fuse contacts; camming the first fuse contact to an open or resiliently deformed position as the movable portion is moved between the first position and the second position, the open position allowing the fuse to move relative first fuse contact without engaging the first fuse contact; and disengaging the first fuse contact from a cam of the movable fuse holder when the movable portion is moved to the second position, allowing the first fuse contact to resiliently move toward a less-stressed position, allowing the first fuse contact to be moved and retained in electrical and mechanical engagement with the fuse when the movable fuse holder is in the second position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
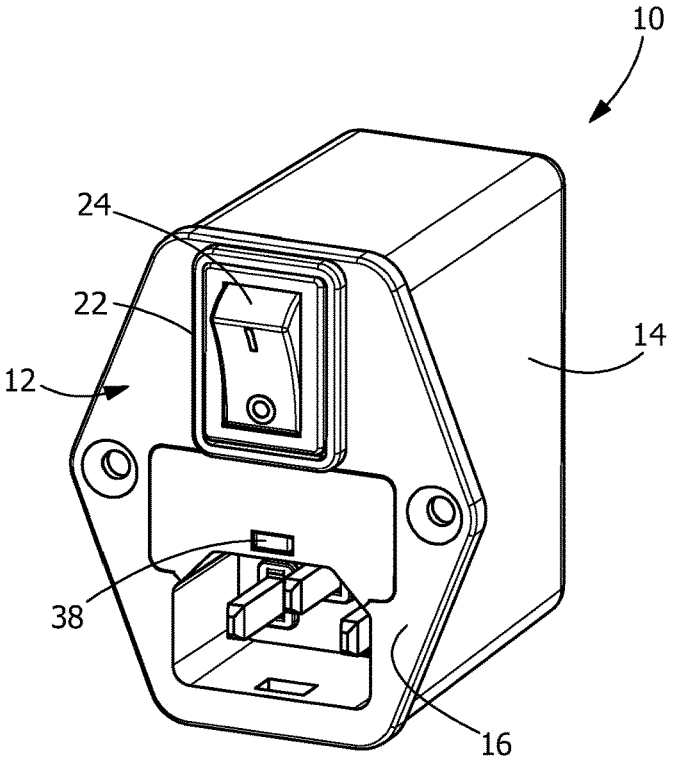
FIG. 1 is a perspective view of an illustrative embodiment of a panel fuse module of the present invention with a movable fuse holder fully inserted second position.
Figure 2:
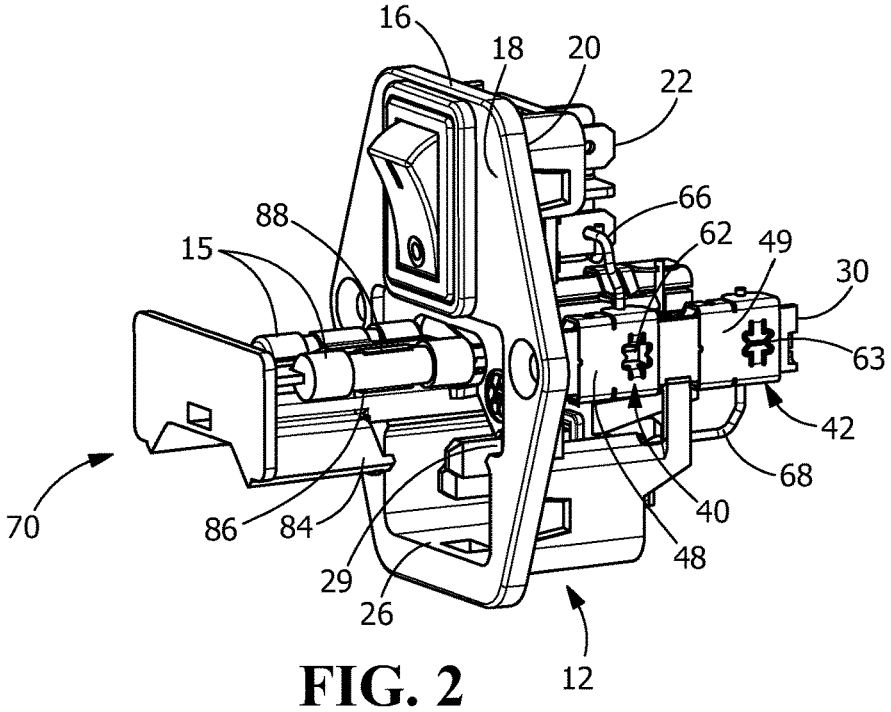
FIG. 2 is a side perspective view of the panel fuse holder of FIG. 1 with a casing of the housing removed and the movable fuse holder provided in a first position to allow one or more fuses to be inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIGS. 1-6, an illustrative panel fuse module 10 includes a housing 12 with a cover 14. In the embodiment shown, the panel fuse module 10 is configured to receive two fuses 15 thereon. However, in other configurations, the panel fuse module may be configured to receive one or more fuses therein.

The housing 12 has a front wall 16 with an outwardly facing surface 18 and an inwardly facing surface 20. A switch 22 extends through the front wall 16 and has a rocker 24 which extends proximate the outward facing surface 18. A plug-receiving cavity 26 extends from the outwardly facing surface 18. The plug-receiving cavity 26 has contacts 28 which extend therein for making a mechanical and electrical connection with a mating plug (not shown). A fuse holder-receiving opening 29 extends through the front wall 16 and is dimensioned to receive a movable fuse holder 70 therein, as will be more fully described.

Figure 3:
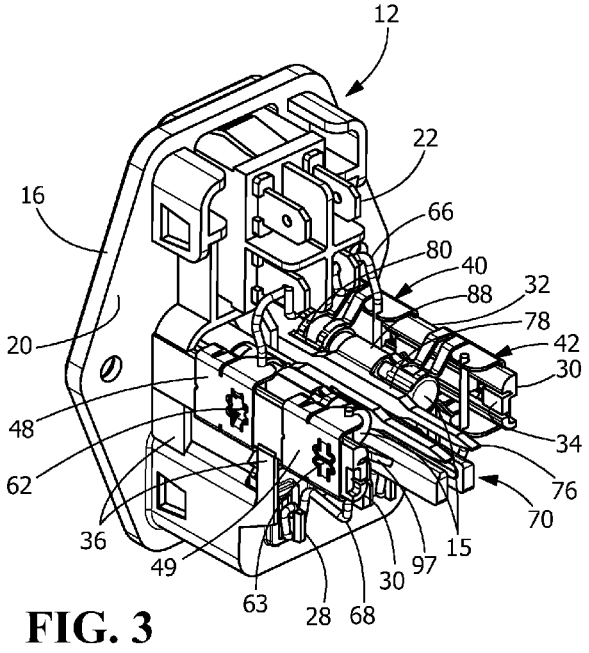
FIG. 3 is a back perspective view of the panel fuse holder of FIG. 1 with a casing of the housing removed and the movable fuse holder provided in the fully inserted second position.

Two posts 30 extend from the inwardly facing surface 20 of the front wall 16 in a direction away from the outwardly facing surface 18. The posts 30 are essentially mirror images of each other and are positioned on either side of the movable fuse holder-receiving opening 29. Each post 30 has an outer surface 32 (FIG. 3) and a contoured inner surface 34 (FIG. 3). Supports 36 may be provided to provide additional support and stabilization to the posts 30. A fixed guide rail 38 extends from the plug-receiving cavity 26 both outwardly toward the surface 18 and inwardly. The fixed guide rail 38 (FIG. 1) is positioned and configured to cooperate with the movable fuse holder 70 to maintain the movable fuse holder 70 in proper position relative to the posts 30 and the housing 12.

A first fuse contact 40 and a second fuse contact 42 are positioned on each post 30. The first fuse contacts 40 are fixed to the posts 30 proximate to the inwardly facing surface 20 of the front wall 16. The second fuse contacts 42 are spaced from the first fuse contacts 40 and are positioned proximate a distal end 44 of the posts 30.

Figure 7:
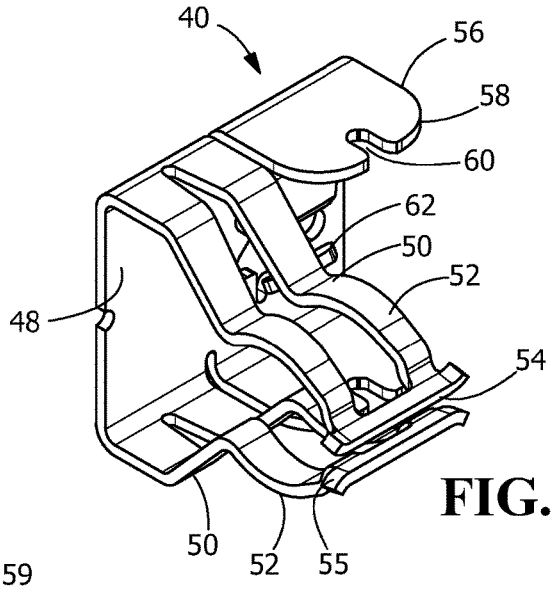
FIG. 7 is a perspective view of an illustrative first fuse contact of the panel fuse holder of FIG. 1.

As best shown in FIG. 7, each of the first fuse contacts 40 has plate portion 48 with resilient fuse engagement contact arms 50 which extend from a top and bottom (as viewed in FIG. 7) of the plate portion 48. The resilient fuse engagement contact arms 50 that extend from the bottom of the plate portion 48 are essentially mirror images of the resilient fuse engagement contact arms 50 that extend from the top of the plate portion 48. Each resilient fuse engagement contact arm 50 has an arcuate shaped section 52 which is configured to engage a respective fuse 15. A cam engagement portion 54 is provided at the free end of each of the resilient fuse engagement contact arms 50. Lead-in portions 55 are provide at each end of the cam engagement portion 54 to facilitate the movement of the cam engagement portion 54 relative to the camming members.

The plate portions 48, 49 are optional and are used if the fuse contacts 40, 42 are not bypassed by the wires 66, 68 from the switch 22 and contacts 28. When present, the plate portions 48, 49 are symmetrical to provide double-fusing.

Positioned proximate the resilient fuse engagement contact arms 50 of each fuse contact 40 is a wire termination portion 56. The wire termination portion 56 has wire termination arms 58 which extend from a top and bottom (as viewed in FIG. 7) of the plate portion 48. The wire termination arms 58 that extend from the bottom of the plate portion 48 are essentially mirror images of the wire termination arms 58 that extend from the top of the plate portion 48. Each wire termination arm 58 has a wire receiving slot 60 which is configured as a wire engagement slot.

The plate portions 48 have securing members 62 which are formed therein. The securing members 62 cooperate with the posts 30 to help retain and maintain the fuse contacts 40, 42 in position on the posts 30. The plate portions 48 have a relatively large surface area which allows for superior transmission of heat away from the fuses 15. The transmission of heat is also facilitated by the location of the plate portions 48 on the outer surface 32 of the posts 30, directly adjacent to the wall of the outer cover 14, where more air circulation is available to cool the plate portions 48.

The plate portions 48 extends over the outer surface 32. The resilient fuse engagement contact arms 50 and the wire termination arms 58 extend from the plate portions over the posts 30 past the contoured inner surface 34 and into a movable fuse holder receiving passage which aligns with the movable fuse holder-receiving opening 29.

Figure 8:
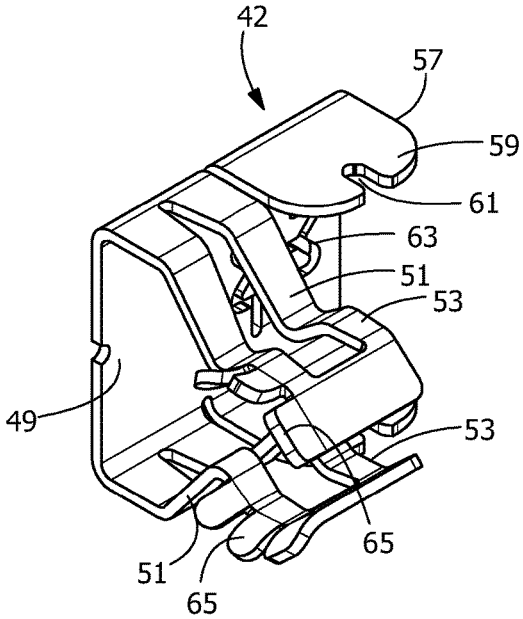
FIG. 8 is a perspective view of an illustrative second fuse contact of the panel fuse holder of FIG. 1.

As best shown in FIG. 8, each of the second fuse contacts 42 has plate portion 49 with resilient fuse engagement contact arms 51 which extend from a top and bottom (as viewed in FIG. 8) of the plate portion 49. The resilient fuse engagement contact arms 51 that extend from the bottom of the plate portion 49 are essentially mirror images of the resilient fuse engagement contact arms 51 that extend from the top of the plate portion 49. Each resilient fuse engagement contact arm 51 has an arcuate shaped section 53 which is configured to engage a respective fuse 15. Lead-in portions 65 are provide at the leading end of the arcuate shaped section 53 to help guide the end of the fuse 15 into engagement with the arcuate shaped section 53.

Positioned proximate the resilient fuse engagement contact arms 51 of each fuse contact 42 is a wire termination portion 57. The wire termination portion 57 has wire termination arms 59 which extend from a top and bottom (as viewed in FIG. 8) of the plate portion 49. The wire termination arms 59 that extend from the bottom of the plate portion 49 are essentially mirror images of the wire termination arms 59 that extend from the top of the plate portion 49. Each wire termination arm 59 has a wire receiving slot 61 which is configured as a wire engagement slot.

The plate portions 49 have securing members 63 which are formed therein. The securing members 63 cooperate with the posts 30 to help retain and maintain the fuse contacts 42 in position on the posts 30. The plate portions 49 have a relatively large surface area which allows for superior transmission of heat away from the fuses 15. The transmission of heat is also facilitated by the location of the plate portions 49 on the outer surface 32 of the posts 30, directly adjacent to the wall of the outer cover 14, where more air circulation is available to cool the plate portions 49.

The plate portions 49 extends over the outer surface 32. The resilient fuse engagement contact arms 51 and the wire termination arms 59 extend from the plate portions over the posts 30 past the contoured inner surface 34 and into a movable fuse holder receiving passage which aligns with the movable fuse holder-receiving opening 29.

Wires 66 extend from the switch 22 to the first fuse contacts 40. Wires 68 extend from the contacts 28 to the second fuse contacts 42. Although wires are shown, other methods and devices for making the electrical connection between the switch 22 and the first fuse contacts 40 and between the contacts 28 and the second fuse contacts 42 can be used, such as, for example, using stamped and formed metal leads.

Figure 9:
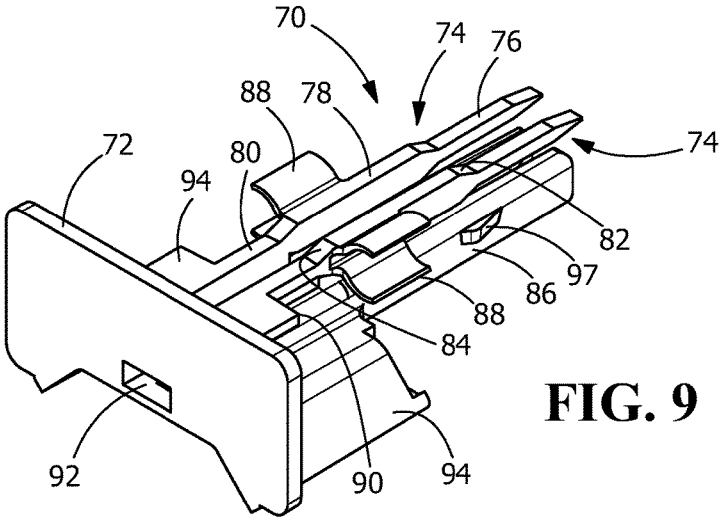
FIG. 9 is a perspective view of an illustrative movable fuse holder of the panel fuse holder of FIG. 1.

As best shown in FIG. 9, the movable fuse holder 70 has an end plate 72. The end plate 72 is provided to prevent the movable fuse holder 70 from being inserted too far into the housing 12, thereby preventing damage to the fuses 15 and the first and second fuse contacts 40, 42 as the movable fuse holder 70 is moved to the second position. The end plate 72 also cooperates with the mating plug when the mating plug in inserted into the plug-receiving cavity 26 to prevent the movable fuse holder 70 from being moved from the second position when the mating plug is in electrical engagement with the panel fuse module 10. The end plate 72 also prevents the user from contact with live parts of the panel fuse module 10.

Camming members 74 are provided on the movable fuse holder 70 and extend proximate to and are essentially parallel to a longitudinal axis of the movable fuse holder 70. As best shown in FIG. 9, each of the camming members 74 have a tip section 76, a raised section 78 and a release section 80.

Figure 5:
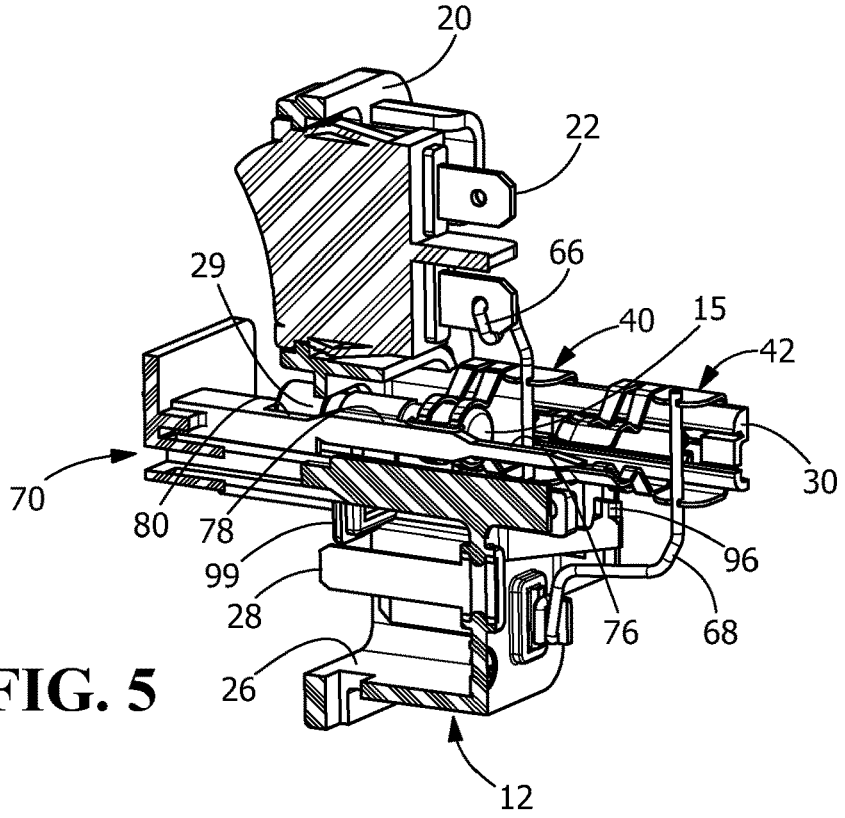
FIG. 5 is a cross-sectional view of the panel fuse holder of FIG. 1 with the movable fuse holder shown between the first position and the second position.

The height of the raised section 78 is greater than the height of the tip section 76 or the release section 80. A ramp 82 is provided between the raised section 78 and the tip section 76. The raised section 78 engages the cam engagement portions 54 of a first fuse contact 40 when the movable fuse holder 70 is moved from the first position toward the second position, as shown in FIG. 5. In this position, the resilient fuse engagement contact arms 50 are more-stressed or resiliently deformed a sufficient distance to allow the fuse 15 to be moved through the arcuate shaped sections 52 of the first fuse contact 40 without the fuse 15 engaging the arcuate shaped sections 52.

Figure 6:
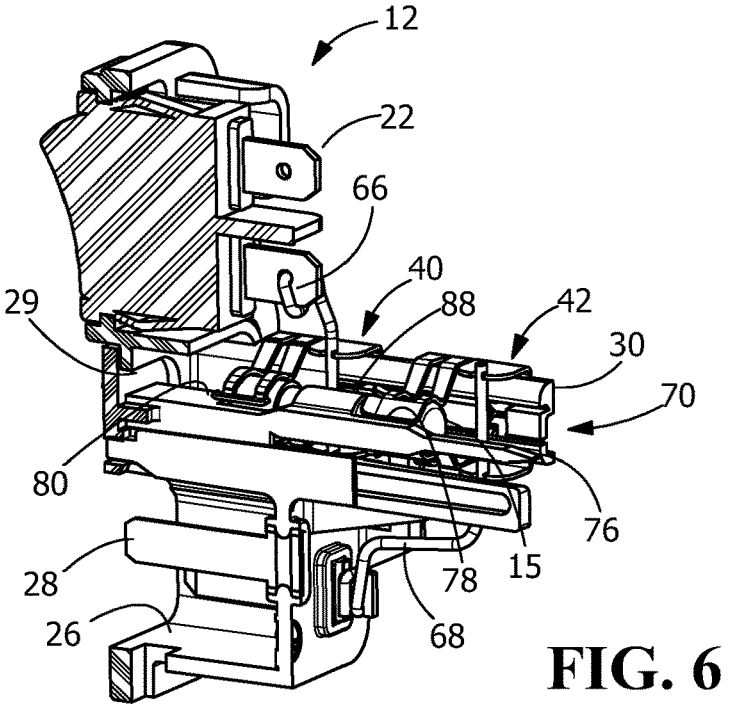
FIG. 6 is a cross-sectional view of the panel fuse holder of FIG. 1 with the movable fuse holder shown in the second position.

The height of the release section 80 is less than the height of the tip section 76 or the raised section 80. A ramp 84 is provided between the release section 80 and the raised section 78. The release section 80 is dimensioned such that the cam engagement portions 54 of the first fuse contact 40 do not engage when the release section 80 of the movable fuse holder 70 when the movable fuse holder 70 is in the second position or proximate to the second position, as shown in FIG. 6. In this position, the resilient fuse engagement contact arms 50 are not prohibited by the movable fuse holder 70 from returning to their less-stressed position. However, when a fuse 15 is provided, the resilient fuse engagement contact arms 50 will engage the fuse 15 prior to reaching the less-stressed position, thereby ensuring that the arcuate shaped sections 52 of the resilient fuse engagement contact arms 50 of the first fuse contacts 40 exert a force on the fuse to maintain a mechanical and electrical connection between the first fuse contact 40 and the fuse 15.

In various embodiments, the release section 80 may be positioned to allow the resilient fuse engagement contact arms 50 to be released from the raised section 80 just prior to the movable fuse holder 70 reaching the second position. This allows the arcuate shaped sections 52 of the resilient fuse engagement contact arms 50 to provide a wiping action to the fuse 15 to eliminate and oxides or contaminants on the surface of the fuse 15.

The second fuse contacts 42 are maintained in a fixed position on the posts 30. The second fuse contacts 42 do not engage the camming members 74 of the movable fuse holder 70. Consequently, as the movable fuse holder 70 is moved to the second position, the end of each fuse 15 enters the resilient fuse engagement contact arms 51, causing the arcuate shaped sections 53 of the resilient fuse engagement contact arms 51 to move to a slightly more-stressed position, thereby ensuring that the arcuate shaped sections 53 of the resilient fuse engagement contact arms 51 of the second fuse contacts 42 exert a force on the fuse 15 to maintain a mechanical and electrical connection between the second fuse contact 42 and the fuse 15. This also allows the arcuate shaped sections 53 of the resilient fuse engagement contact arms 51 of the second fuse contacts 42 to provide a wiping action to the fuse 15 to eliminate any oxides or contaminants on the surface of the fuse 15. The positioning of the fuse 15 between the arcuate shaped sections 53 of the resilient fuse engagement contact arms 51 is guided by the lead-in portions 65

Fuse retention sections 86 are provided on the movable fuse holder 70 proximate the camming members 74. The fuse retention sections 86 have spring clips 88 which cooperate with the fuses 15 to maintain the fuses 15 in position on the movable fuse holder 70. Positioning shoulders 90 are provided and cooperate with the fuses 15 to allow the fuses 15 to be properly positioned in the fuse retention sections 68.

A guide rail receiving slot 92 extends through the movable fuse holder 70. The guide rail receiving slot 92 cooperates with the guide rail 38 to maintain the movable fuse holder 70 in proper position in the movable fuse holder receiving passage as the movable fuse holder 70 moves between the first and the second position. Stabilization members 94 also are provided on the movable fuse holder 70. The stabilization members 94 prevent unwanted movement of the movable fuse holder 70 when the movable fuse holder 70 is in the second position.

The fuse holder 70 includes a foot 99 that prevents connection of the input terminals to power by a mating plug until the protective plate 72 blocks access through the fuse holder-receiving opening 29 to live metal parts by the end user. The fuse holder 70 does not cause connection of the fuses 15 to potentially live parts until the protective plate 72 blocks access by the end user.

A detent 97 on the fuse retention sections 86 of the moveable fuse holder 70 cooperates with a detent 96 on the housing 12 to secure the moveable fuse holder 70 in the fully or completely installed position in the housing 12, whereby a tool is required for the removal of the moveable fuse holder 70 from the housing 12.

In operation, the fuses 15 are positioned in the fuse retention sections 86 and are maintained in position by the spring clips 88. With the fuses 15 properly positioned, the movable fuse holder 70 is moved from the first or open position, shown in FIG. 4, to the second or closed position, shown in FIG. 6. During this movement, the camming members 74 engage the cam engagement portions 54 of the first fuse contact 40. As the insertion of the movable fuse holder 70 continues, the cam engagement portions 54 engage the raised sections 78 of the camming members 74, causing the arcuate shaped sections 52 to be spread apart a greater distance than the diameter of the fuses 15. In so doing, the fuses 15, and the sharp edges associated therewith, are moved through and beyond the arcuate shaped sections 52 without engaging the arcuate shaped sections 52 and without damaging the arcuate shaped sections 52 or the fuses 15.

As the movable fuse holder 70 approaches the second position, the leading ends of the fuses are inserted between the arcuate shaped sections 51 of the second fuse contacts 42, as previously described. As this occurs, the cam engagement portions 54 move from the raised portions 78 of the camming members 74 allowing the resilient fuse engagement contact arms 50 to return toward the less-stressed position to make electrical and mechanical engagement with the trailing end of the fuses 15, as previously described.

When the movable fuse holder 70 is in the second position, the first fuse contacts 40 and the second fuse contacts 42 are provided in electrical and mechanical engagement with the fuses 15. In this position, fuses 15 behave in a manner known in the art, allowing the electrical current to flow form the mating plug through the fuses 15 to the switch 22.

Figure 4:
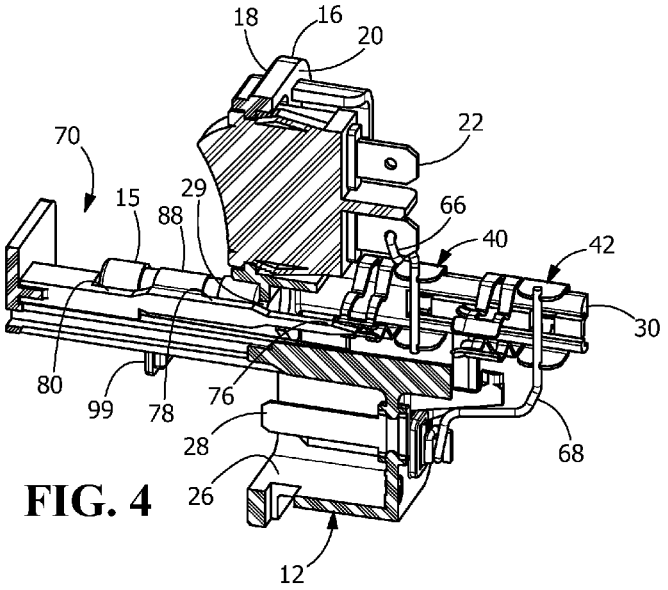
FIG. 4 is a cross-sectional view of the panel fuse holder of FIG. 1 with the movable fuse holder shown in the first position with a fuse positioned therein.

When the fuses are to be removed or replaced, fuse holder 70 is moved from the second or closed position, shown in FIG. 6 to the first or open position, shown in FIG. 4. During this movement, the camming members 74 engage the cam engagement portions 54 of the first fuse contact 40. As the removal of the movable fuse holder 70 continues, the cam engagement portions 54 engage the raised sections 78 of the camming members 74, causing the arcuate shaped sections 52 to be spread apart a greater distance than the diameter of the fuses 15. In so doing, the fuses 15, and the sharp edges associated therewith, are moved through and beyond the arcuate shaped sections 52 without engaging the arcuate shaped sections 52 and without damaging the arcuate shaped sections 52 or the fuses 15.

The configuration of the panel fuse module 10 and the fuse contacts 40, 42 allows for proper insulation, contact stability and large current capability. Both the first fuse contacts and the second fuse contacts are permanently connected to the housing circuit, are metal and are preloaded to maintain a stable fuse contact. Consequently, the fuse contacts 40, 42 provide a good electrical connection with the fuses. In addition, the configuration of the plate portions 48, 49 of the contacts 40, 42 and their positioning on posts 30 provides for superior transmission of heat away from the fuses, with the minimal panel footprint of an axial fuse holder. Consequently, the panel fuse module 10 combines the compact advantage of axial fuse holders with the thermal advantages of radial fuse holders.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A panel fuse module for use with one or more fuses, the panel fuse module comprising:

a housing;

a first fuse contact mounted on the housing, the first fuse contact is resiliently deformable, the first fuse contact has first resilient fuse engagement contact arms which have arcuate shaped sections configured to engage a respective fuse of the one or more fuses, cam engagement portions are provided at the free ends of the contact arms;

a second fuse contact mounted on the housing and spaced from the first fuse contact, the second fuse contact has second fuse engagement contact arms which have arcuate shaped sections configured to engage the respective fuse of the one or more fuses;

a movable fuse holder which is moveable relative to the housing and relative to the first fuse contact, the movable housing being movable from a first position in which the one or more fuses may be inserted into the movable fuse holder without engaging the first fuse contact or the second fuse contact to a second position in which the movable fuse holder is inserted into the housing;

a cam member provided on the movable fuse holder;

wherein as the movable fuse holder is moved from the first position toward the second position, the cam member cooperates with the cam engagement portions of the first resilient fuse engagement contact arms of the first fuse contact to move the first resilient fuse engagement contact arms of the first fuse contact from a less-stressed first position to a more-stressed second position to allow the respective fuse of the one or more fuses to be inserted into the housing without engaging the first resilient fuse engagement contact arms of the first fuse contact;

wherein as the movable fuse holder is moved into the second position, the cam member disengages the first resilient fuse engagement contact arms of the first fuse contact to allow the first resilient fuse engagement contact arms of the first fuse contact to move toward the less-stressed first position to allow the first resilient fuse engagement contact arms of the first fuse contact to be provided in mechanical and electrical engagement with the respective fuse of the one or more fuses.

2. The panel fuse module as recited in claim 1, wherein a spring clip provided on the movable fuse holder, the spring clip cooperates with the respective fuse of the one or more fuses to maintain the respective fuse of the one or more fuses in position on the moveable fuse holder.

3. The panel fuse module as recited in claim 1, wherein the first fuse contact has a wire termination portion proximate the first resilient fuse engagement arms, the wire terminal portion having wire engagement slots for terminating a wire.

4. The panel fuse module as recited in claim 3, wherein the second fuse contact has a wire termination portion proximate the second resilient fuse engagement arms, the wire terminal portion having wire engagement slots for terminating a wire.

5. The panel fuse module as recited in claim 1, wherein the second fuse contact is not moved by the cam member.

6. The panel fuse module as recited in claim 1, wherein the first and second fuse contacts have a heat dissipation plate extending over a side of a fixed post which is opposed to the respective fuse, the heat dissipation plate dissipates the heat generated by the respective fuse.

7. The panel fuse module as recited in claim 1, wherein the housing has a guide rail which cooperates with the movable fuse holder to guide the movement of the movable fuse holder between the first position and the second position and the retain the movable fuse holder in the housing.

8. A panel fuse module for use with one or more fuses, the panel fuse module comprising:

a housing having a fixed post, a fixed rail and a fuse holder, the fuse holder being movable relative to the fixed post and the fixed rail from a first position in which a respective fuse of the one or more fuses is positioned in the fuse holder to a second position in which the respective fuse and the fuse holder are inserted into the housing;

a first fuse contact mounted on the fixed post proximate the front of the housing;

a second fuse contact mounted on the fixed post spaced from the first fuse contact toward the rear of the housing;

a cam member provided on the movable fuse holder, the cam member extending proximate to and essentially parallel to a longitudinal axis of the fuse holder, the camming member having a tip section, a raised section and a release section, a height of the raised section is greater than a height of the tip section, a height of the release section is less than the height of tip section or the height of the raised section;

wherein as the fuse holder is moved from the first position toward the second position, the raised section of the cam member cooperates with the first fuse contact to move the first fuse contact from a less-stressed first position to a more-stressed second position to allow the respective fuse to be inserted into the housing without engaging the first fuse contact;

wherein as the fuse holder is moved into the second position, the release section of the cam member is aligned with the first fuse contact causing the cam member to disengage the first fuse contact to allow the first fuse contact to move toward the less-stressed first position and engage the respective fuse of the one or more fuses to allow the first fuse contact to be provided in mechanical and electrical engagement with the respective fuse of the one or more fuses.

9. The panel fuse module as recited in claim 8, wherein the fuse holder has spring clips to maintain the respective fuse in position.

10. The panel fuse module as recited in claim 8, wherein the first fuse contact has resilient fuse engagement arms with cam engagement portions provided at free ends thereof, the cam engagement portions engage the cam member when the first fuse contact is in an open position.

11. The panel fuse module as recited in claim 10, wherein the first fuse contact has a wire termination portion proximate the resilient fuse engagement arms, the wire terminal portion having wire engagement slots for terminating a wire.

12. The panel fuse module as recited in claim 8, wherein the second fuse contact has resilient fuse engagement arms and a wire termination portion proximate the resilient fuse engagement arms, the wire terminal portion having wire engagement slots for terminating a wire.

13. The panel fuse module as recited in claim 8, wherein the first and second fuse contacts have a heat dissipation plate extending over a side of the fixed post which is opposed to the respective fuse, the heat dissipation plate dissipates heat generated by the respective fuse.

14. A method of terminating a fuse in a fuse panel module, the fuse module having a first fuse contact and a second fuse contact, the method comprising:

inserting the fuse into a movable fuse holder of the fuse panel module;

moving the movable fuse holder from a first position in which the fuse does not engage the first or second fuse contact to a second position in which the fuse is provided in mechanical and electrical engagement with the first and second fuse contacts;

camming first resilient fuse engagement contact arms of the first fuse contact to an open, resiliently deformed position as the movable fuse holder is moved between the first position and the second position, the open, resiliently deformed position allowing the fuse to move relative the first fuse contact without engaging the first resilient fuse engagement contact arms of the first fuse contact;

disengaging the first resilient fuse engagement contact arms of the first fuse contact from a cam of the movable fuse holder when the movable fuse holder is moved to the second position, allowing the first resilient fuse engagement contact arms of the first fuse contact to resiliently move toward a less-stressed position, allowing the first resilient fuse engagement contact arms of the first fuse contact to be moved and retained in electrical and mechanical engagement with the fuse when the movable fuse holder is in the second position.

15. The method as recited in claim 14, comprising securing the fuse in the movable fuse holder when the movable fuse holder is in the first position.

16. The method as recited in claim 14, comprising making electrical and mechanical engagement with the fuse when the movable fuse holder is in the second position.

17. The method as recited in claim 14, comprising dissipating heat generated by the fuse through heating dissipating portions of the first and second fuse contacts.

18. The method as recited in claim 14, comprising securing the first and second fuse contacts in position on a post of a housing of the fuse panel module.

19. The method as recited in claim 14, comprising securing the movable fuse holder in the second position to ensure proper electrical connection between the fuse and the first and second contact fuse contacts.

* * * * *